United States Patent [19]

Caligiuri

[11] 3,993,195

[45] Nov. 23, 1976

[54] LOCKABLE GARMENT DISPLAY RACK

[76] Inventor: Joseph M. Caligiuri, 37 Kennedy Place, Tuckahoe, N.Y. 10707

[22] Filed: Dec. 29, 1975

[21] Appl. No.: 644,520

[52] U.S. Cl. ..... 211/7; 211/124

[51] Int. Cl.[2] ..... E05B 73/00

[58] Field of Search ..... 211/7, 4, 123, 124; 70/59, 62

[56] References Cited

UNITED STATES PATENTS

| | | | |
|---|---|---|---|
| 1,029,493 | 6/1912 | De Dontney | 211/7 |
| 1,383,598 | 7/1921 | Campbell | 211/7 |
| 2,068,451 | 1/1937 | Elmore | 211/124 |
| 3,567,034 | 3/1971 | Mozelsio | 211/7 |
| 3,581,905 | 6/1971 | Shapiro et al. | 211/7 |
| 3,690,130 | 9/1972 | Eutzler | 70/59 X |
| 3,735,875 | 5/1973 | Parillo | 211/7 |
| 3,785,499 | 1/1974 | Gedye | 211/4 |

*Primary Examiner*—Roy D. Frazier
*Assistant Examiner*—Robert W. Gibson, Jr.

[57] ABSTRACT

This invention relates to a garment hanger display rack having novel slidable-lockable means for securing the hangers thereon comprised of a channel bar with a series of notches for receiving hangers, collar or other means for securing the bar to a garment rack and slidable lock means for locking the hangers within the rack.

5 Claims, 7 Drawing Figures

LOCKABLE GARMENT DISPLAY RACK

Figures 1, 2, 3, 4, 5, 6, 7:
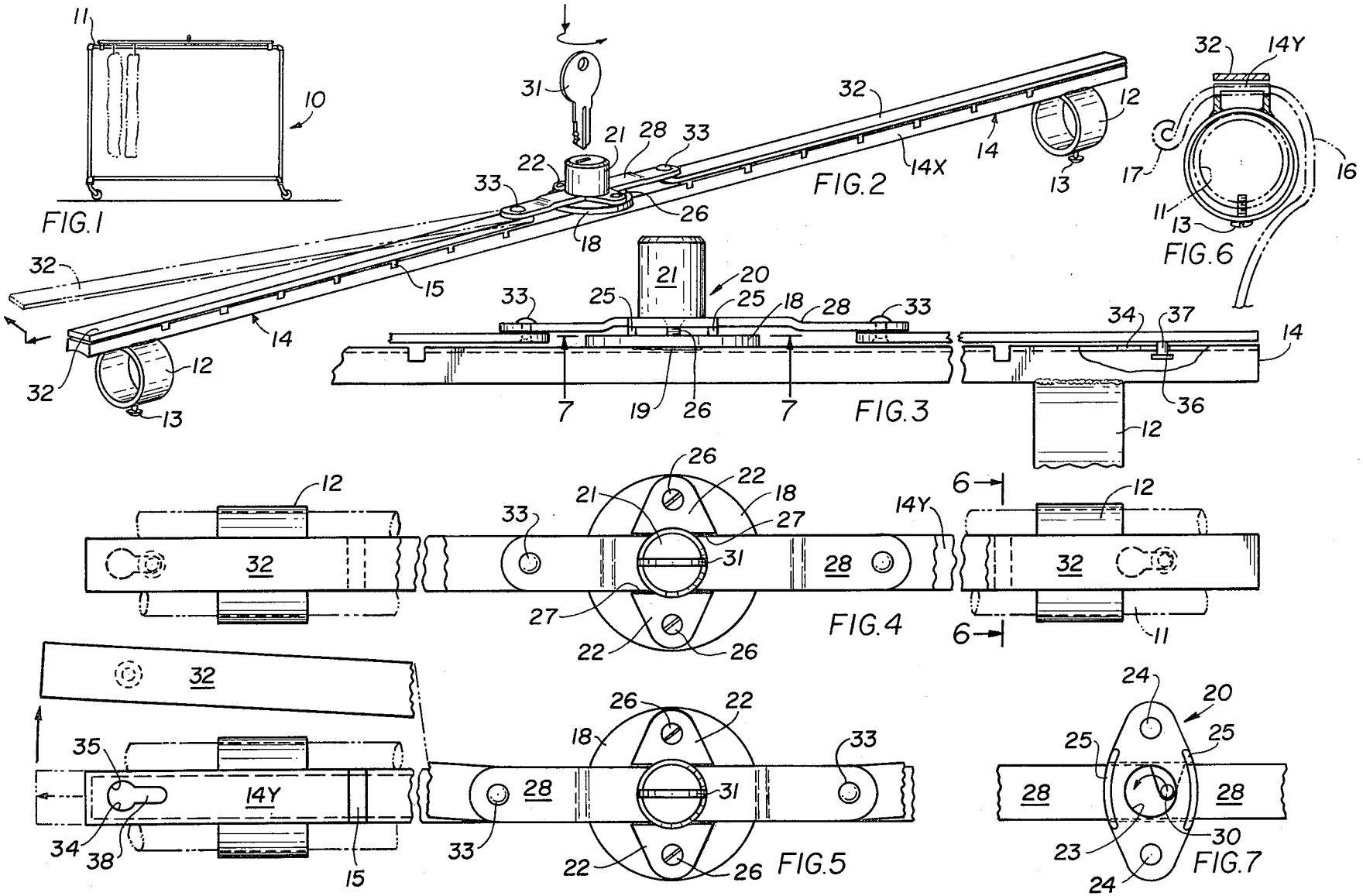

The art of lockable hangers is quite extensive and includes the U.S. Pat. Nos.: 1,383,598; 3,472,385; 3,567,034; 3,659,721 and 3,610,423. This invention is an improvement over this art.

It is an object of this invention to provide a novel garment display rack that is attachable to the conventional rollable garment display apparatus found in clothing stores.

This and other objects of this invention will become apparent upon reading the following descriptive disclosure of an embodiment thereof and shown in the accompanying drawing in which FIG. 1 is a of a conventional display device for clothing provided with this invention thereon FIG. 2 is a perspective view showing a lock assembly secured to a notched hanger bar and slidable bar means passing through and being actuated by said lock assembly to lock said slidable bar means to said hanger bar.

FIG. 3 is an enlarged side view of the rack of FIG. 2, broken away in part, and showing the manner of securing the arms in locked relationship to the notched bar FIG..4 is a top view similar to FIG. 3, showing the lock assembly and its relationship to the slidable bar means therein and to the opposed arms secured thereto, and further showing in dotted outline the manner of securing flanged lock pins disposed on the underside of each arm to co-acting critically shaped apertures disposed in the top wall of the notched bar, to effectuate a selective locking or unlocking of said movable arms to said notched bar FIG. 5 is a top view of the rack, broken away in part, and showing the arm lifted and swung outward, and showing further in dotted outline the movement of the slide of the arm to unlock the arm from the notched bar FIG. 6 is a section view taken on line 6—6 of FIG. 4 and showing a looped hanger hook disposed in a notch of the notched channel bar with the swingable arm disposed thereover in locked position and FIG. 7 is a section view taken on line 7—7 of FIG. 3 and the conventional cam pin action in slidably moving a slide bar having a co-acting V-shaped cam slot therein.

As a statement of this invention, the concept comprises the use of a channel bar having spaced-apart notches therein for receiving hanger hooks having looped ends, collar or other means for securing the channel bar to a conventional display garment rack and slidable-lockable means for locking the hangers within the rack. The channel bar is provided at its center top position with a key assembly fixedly secured thereto, said key assembly being the kind used to lock the many drawers of a file cabinet by use of a bar slidably actuated by movement of the lock key. In this invention the key actuated slide bar is provided at each of its ends with a swingable arm, which arms are provided with depending flanged lock pins which co-act with critically shaped apertures disposed in the ends of said notched bar to thereby lock said arms over and to said notched bar having hangers thereon.

Turning now to a detailed description of an embodiment of this invention, FIG. 1 shows a conventional rollable garment display apparatus 10 having a tubular top pipe 11 for hangers and provided with this invention. The invention is shown in full in FIG. 2 and is secured to both ends of pipe 11 by means of collars 12 and screws 13 co-acting with threaded apertures disposed in pipe 11 (FIG. 6). Other conventional means for securing the novel rack to pipe 11 are feasible. In this example of the invention, a U-shaped channel bar 14 is provided at its ends with collars 12 welded thereto. A plurality of spaced-apart notches 15 are provided through the top wall 14Y and into the opposed side walls 14X. These notches receive the conventional garment hanger 16 having a loop 17 thereon. An important feature of this invention is the manner of locking the hanger 17 to the rack and thus to the display apparatus 10.

As shown in FIG. 2, a holder plate 18 for holding a keylock-slide bar assembly 20 is welded at weld 19 to the top wall 14Y at its central location.

The assembly 20 consists of a barrel portion 21 integral with an ovaloid plate 22 having a groove 27, a pair of spaced apart screw receiving apertures 24 and legs 25. The plate 22 is secured to plate 18 by means of screws 26. As shown in FIGS. 3 and 4 groove 27 is of such a width and depth as to accomodate an offset slide bar 28 having a critically located V-shaped cam slot 29 (FIG. 7) therein adapted to receive cam pin 30 of the rotatable element within barrel portion 21.

Thus the turning of key 31, causes the key retaining cylinder with its cam pin 30 to turn as a unit within barrel 21, thereby causing the lock bar 28 with its slot 29 engaging the pin 30 to slide in groove 27 of plate 22. The key 31, for example, is turned 180° from right to left, to cause the bar 28 to also move in the same direction and to thereby cause both arms 32 to move in a like direction since these arms are secured hingedly to said bar 28 by hinge pins 33. Accordingly, the flange pins 37 are released from their locked position in the aperture portion 38 and are moved to beneath the circular portion 35 of aperture 34 permitting the lifting of the arm ends and thereafter a swinging away of the arms to expose the notches 15 for removal or the loading of garment hangers 16.

The slide bar 28 is secured on each of its ends with swingable arms 32 through a hinge pin 33. The U-shaped channel bar 14 is provided at each of its ends with a critically located and critically shaped locking aperture 34. These apertures are provided with a circular portion 35 for receiving the circular flange 36 of a flange pin 37. A flange pin 37 is critically located in each of the ends of the swingable arms 32 to engage the circular portion 35 of the locking aperture 34. The two apertures 34 are arranged in a like linear order so that the two pins 37 are simultaneously disposed over aperture portions 35.

As shown in FIG. 5, the apertures 34 are of a pear-shaped configuration, having a circular portion 35 merging with a parallel side wall flange 36 locking portion 38, thereby locking flange pin 37 to the U-shaped bar 14. Clearly, the diameter of the flange 36 is greater than the width of the slot of the lock portion 38.

In the operation of this invention, the garments are fixedly secured to the hangers which are then placed in the notches 15 of bar 14, with the arms swung in outward position. The arms 32 are then swung on hinge pins 33 to overlay their respective portions of bar 14 with pins 37 being disposed over the circular hole portions 35 in bar 14. The pins 37 are then depressed into these circular portions 35 and the key 31 is turned to the right (FIG. 5) causing slide bar 28 and the two arms 32 to move as a unit to the right so that flanges 36 also move to the right and under the slot lock portion 38.

The unlocking procedure is the reverse of locking procedure, so that movement of the key to the left, causes slide bar 28 and the two arms to move to the left placing the flange 36 of pin 37 in the circular portion 35, which portion being of a greater diameter allows the flange 36 to be removed from bar 14, to permit the swinging away of the arms 32.

This invention has been described with an illustrative embodiment, but it is of greater scope as it includes all obvious changes thereto. Thus, for example, a single arm 32 variation is produced by eliminating one-half of the structure to one side of the key assembly. Also the rollaway display device 10 may be made with the channel bar 14 replacing the pipe 11. Moreover, the bar 14 may be made without notches 15, to accomodate slidable hangers 16 thereon in contacting relationship yet captively locked between bar 14 and an arm 32.

I claim:

1. A lockable device for garment hangers comprising a U-shaped Channel bar having a top wall and parallel side walls, said top wall having at least one substantially pear-shaped lock aperture at the end thereof, said aperture having a circular aperture portion continuous with a parallel edge slot aperture portion adapted to lockingly engage a lock flange; a key assembly, having a rotatable element within a barrel actuated by a key rotation of 180°, said element having a cam pin for engagement with a cam slot, and having further a grooved plate fixedly secured to said barrel with the groove thereunder, and having further a slide bar disposed slidably in said groove and with said cam slot therein to engage said cam pin; at least one arm hingedly secured to an end of said slide bar, said arm having at its end a depending flanged lock pin, whereby swinging of said arm over the top wall of said channel bar with the flanged hinge pin over the circular portion of said pear-shaped aperture permits the depression of said pin into the circular portion and the turning of said key barrel effects a movement of the slide bar and the arm to force the flange of said lock pin into locking relationship into the slot portion of said aperture.

2. The device of claim 1, wherein the slide bar is hingedly secured at each of its two ends to a respective swingable arm.

3. The device of claim 1, wherein the U-shaped bar is provided with spaced-apart notches to arrange the garments is a spaced-apart manner.

4. The device of claim 1, wherein the U-shaped bar is provided with end means for securing the bar to a pipe of a display hanger.

5. The device of claim 4, wherein the end securing means are collars.

* * * * *